US011081049B2

(12) United States Patent
Hyun

(10) Patent No.: US 11,081,049 B2
(45) Date of Patent: Aug. 3, 2021

(54) PIXEL AND DISPLAY DEVICE HAVING THE SAME

(71) Applicant: Samsung Display Co., Ltd., Yongin-si (KR)

(72) Inventor: Chae Han Hyun, Yongin-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/653,046

(22) Filed: Oct. 15, 2019

(65) Prior Publication Data

US 2020/0211459 A1 Jul. 2, 2020

(30) Foreign Application Priority Data

Dec. 28, 2018 (KR) ..... 10-2018-0172891

(51) Int. Cl.
*G09G 3/3233* (2016.01)

(52) U.S. Cl.
CPC ... *G09G 3/3233* (2013.01); *G09G 2310/0278* (2013.01); *G09G 2320/0233* (2013.01); *G09G 2330/021* (2013.01); *G09G 2330/028* (2013.01)

(58) Field of Classification Search
CPC ..... G09G 3/3233; G09G 2320/045; G09G 2300/0819; G09G 3/3258; G09G 3/3283; G09G 3/3291
See application file for complete search history.

(56) References Cited

U.S. PATENT DOCUMENTS

| | | | | |
|---|---|---|---|---|
| 9,024,934 | B2 | 5/2015 | Park et al. | |
| 9,805,651 | B2 | 10/2017 | Kim | |
| 2016/0322446 | A1* | 11/2016 | Park | G09G 3/3266 |
| 2017/0124939 | A1* | 5/2017 | Kang | H01L 27/3265 |
| 2017/0221422 | A1* | 8/2017 | Hwang | G09G 3/3233 |

FOREIGN PATENT DOCUMENTS

| | | | |
|---|---|---|---|
| KR | 10-0570995 | B1 | 4/2006 |
| KR | 10-2014-0013586 | A | 2/2014 |
| KR | 10-2015-0144893 | A | 12/2015 |

* cited by examiner

*Primary Examiner* — Dennis P Joseph

(74) *Attorney, Agent, or Firm* — Lewis Roca Rothgerber Christie LLP

(57) ABSTRACT

A pixel in a display device includes a light emitting element, a first transistor for controlling an amount of current flowing from a first power source to a second power source via the light emitting element corresponding to a voltage applied to a first node, and second and third transistors coupled in series between a holding power source and a second node coupled to one electrode of the first transistor, wherein the second transistor includes a gate electrode coupled to an emission control line, and wherein the third transistor includes a gate electrode coupled to a scan line.

15 Claims, 6 Drawing Sheets

PIXEL AND DISPLAY DEVICE HAVING THE SAME

CROSS-REFERENCE TO RELATED APPLICATION

The application claims priority to and the benefit of Korean Patent Application No. 10-2018-0172891, filed in the Korean Intellectual Property Office (KIPO) on Dec. 28, 2018, which is hereby incorporated by reference in its entirety.

BACKGROUND

1. Field

Exemplary embodiments relate to a display device, and more particularly, to a pixel and a display device having the same.

2. Discussion

A display device displays an image using pixels that emit light of various colors (for example, red light, green light, and blue light). The display device may control luminance of the pixels using impulse dimming that controls ON/OFF duty (i.e., a light emitting period, or a pulse width) of an emission control signal.

Each of pixels may include a light emitting element and a plurality of transistors for driving the light emitting element. However, threshold voltages of the transistors may be shifted by temperature change, deterioration due to use, and the like. As a result, a driving current of the transistors may be changed by turning on the transistors in a non-light emitting period for luminance dimming (luminance control), and the light emitting element may emit light with an undesired luminance or an undesired grayscale level.

SUMMARY

An aspect of example embodiments of the invention is to provide a pixel that prevents a turn-on of transistors in a non-light emitting period by supplying a predetermined voltage to a first electrode (a second node) of a first transistor in the non-light emitting period.

Another aspect of example embodiments of the invention is to provide a display device having the pixel.

However, aspects of example embodiments of the invention are not limited to the above-mentioned aspects, and can be variously expanded without departing from the spirit and scope of the invention.

According to some embodiments, a pixel may include a light emitting element; a first transistor for controlling an amount of current flowing from a first power source to a second power source via the light emitting element corresponding to a voltage applied to a first node; and second and third transistors coupled in series between a second node connected to one electrode of the first transistor and a holding power source, wherein the second transistor may include a gate electrode coupled to an emission control line, and wherein the third transistor may include a gate electrode coupled to a scan line.

The first transistor may be of a different type from the second and third transistors.

The second and third transistors may be NMOS transistors, and the first transistor may be a PMOS transistor.

The pixel may further include a fourth transistor coupled between a data line and the second node, the fourth transistor including a gate electrode coupled to the scan line; a fifth transistor coupled between the first node and a third node, the fifth transistor including a gate electrode coupled to the scan line; a sixth transistor coupled between the first power source and the second node, the sixth transistor including a gate electrode coupled to the emission control line; a seventh transistor coupled between the third node and the light emitting element, the seventh transistor including a gate electrode coupled to the emission control line; and a storage capacitor coupled between the first power source and the first node.

The pixel may further include an eighth transistor coupled between the first node and an initialization power source, the eighth transistor including a gate electrode coupled to a previous scan line; and a ninth transistor coupled between the initialization power source and the light emitting element, the eighth transistor including a gate electrode coupled to the scan line.

The holding power source and the initialization power source may be the same.

A voltage of the holding power source may be lower than a lowest voltage of a data voltage supplied to the data line.

The first transistor and the fourth through ninth transistors may be PMOS transistors, and the second and third transistors may be NMOS transistors.

The fourth transistor may include a multiple gate electrode transistor that is commonly coupled to the scan line.

An emission control signal may be applied to the emission control line a plurality of times during one frame period.

The second transistor may be turned on in response to a logic high level of the emission control signal, and the third transistor may be turned on in response to a logic high level of a scan signal.

The sixth and seventh transistors may be turned on in response to a logic low level of the emission control signal.

The fourth and fifth transistors may be turned on in response to a logic low level of the scan signal.

According to some embodiments, a display device may include a display panel including a plurality of pixels; a scan driver for supplying scan signals to the plurality of pixels through a plurality of scan lines; an emission driver for supplying emission control signals to the plurality of pixels through a plurality of emission control lines; and a data driver for supplying data voltages to the display panel through a plurality of data lines, wherein an (m, n) pixel of the plurality of pixels (m and n are natural numbers) may include a light emitting element; a first transistor for controlling an amount of current flowing from a first power source to a second power source via the light emitting element corresponding to a voltage applied to a first node; and second and third transistors coupled in series between a second node coupled to one electrode of the first transistor and a holding power source, wherein the second transistor may include a gate electrode coupled to an (n)th emission control line, and wherein the third transistor may include a gate electrode coupled to an (n)th scan line.

The (m, n) pixel may further include a fourth transistor coupled between an (m)th data line and the second node, the fourth transistor including a gate electrode coupled to the (n)th scan line; a fifth transistor coupled between the first node and a third node, the fifth transistor including a gate electrode coupled the (n)th scan line; a sixth transistor coupled between the first power source and the second node, the sixth transistor including a gate electrode coupled to an (n)th emission control line; a seventh transistor coupled between the third node and the light emitting element, the seventh transistor including a gate electrode coupled to the (n)th emission control line; and a storage capacitor coupled between the first power source and the first node.

The (m, n) pixel may further comprise an eighth transistor coupled between the first node and an initialization power source, the eighth transistor including a gate electrode coupled to an (n−1)th scan line; and a ninth transistor coupled between the initialization power source and the light emitting element, the ninth transistor including a gate electrode coupled to the (n)th scan line.

The second and third transistors may be NMOS transistors, and the first transistor, and the fourth through ninth transistors may be PMOS transistors.

The emission control signal may be supplied to the (n)th emission control line a plurality of times during one frame period.

The holding power source and the initialization power source may be the same.

BRIEF DESCRIPTION OF THE DRAWINGS

The accompanying drawings, which are included to provide a further understanding of the inventive concepts, and are incorporated in and constitute a part of this specification, illustrate exemplary embodiments of the inventive concepts, and, together with the description, serve to explain principles of the inventive concepts.

DETAILED DESCRIPTION

Figure 1:
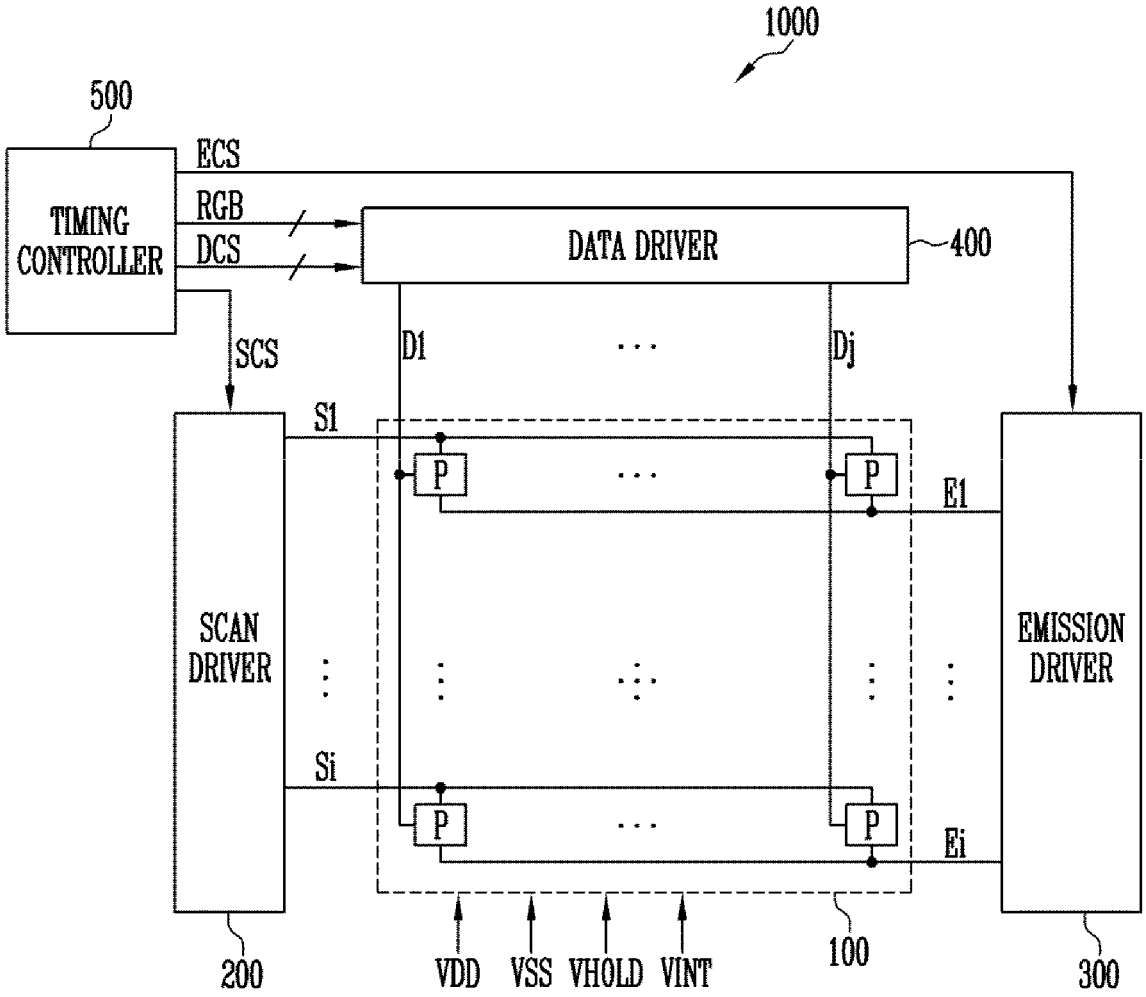
FIG. 1 is a block diagram illustrating a display device according to an embodiment of the invention.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," or "coupled to" another element or layer, it can be directly on, connected to, or coupled to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

The display device and/or any other relevant devices or components according to embodiments of the present invention described herein may be implemented utilizing any suitable hardware, firmware (e.g., an application-specific integrated circuit), software, or a combination of software, firmware, and hardware. For example, the display device may include a display panel, a scan driver an emission driver, a data driver, a timing controller, and a power supply unit. The various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display device according to an embodiment of the invention.

Referring to FIG. 1, a display device 1000 may include a display panel 100, a scan driver 200, an emission driver 300, a data driver 400, and a timing controller 500.

As another embodiment, the display device 1000 may further include a power supply unit for supplying the display panel 100 with a voltage of a first power source VDD, a voltage of a second power source VSS, a voltage of a holding power source VHOLD, and a voltage of an initialization power source VINT. However, as another embodiment, at least one of the first power source VDD, the second power source VSS, the holding power source VHOLD, and the initializing power source VINT may be supplied from the timing controller 500 or the data driver 400.

The first power source VDD and the second power source VSS may generate voltages for driving a pixel P having a light emitting element LED. In one embodiment, the voltage of the second power source VSS may be lower than that of the first power source VDD.

In one embodiment, the voltage of the holding power source VHOLD and the voltage of the initialization power source VINT may be the same. For example, the holding power source VHOLD and the initialization power source VINT may be the same power source. In another embodiment, the voltage of the holding power source VHOLD may be lower than that of the initialization power source VINT. Here, the voltages of the holding power source VHOLD and the initialization power source VINT may be set to any suitable value within a range of about −4.5 V to about −3.5 V.

In one embodiment, the display device 1000 may be provided with a dimming scheme for adjusting an off-duty ratio and/or an off-duty cycle of an emission control signal in order to control the luminance of the display device 1000.

The display panel 100 may include a plurality of scan lines S1 to Si, a plurality of emission control lines E1 to Ei, a plurality of data lines D1 to Dj, and a plurality of pixels P coupled to the scan lines S1 to Si, the emission control lines E1 to Ei, and the data lines D1 to Dj, where i and j are integers greater than 1. Each of the pixels P may include a driving transistor and a plurality of switching transistors.

The scan driver 200 may sequentially supply scan signals to the pixels P through the scan lines S1 to Si according to a first control signal SCS. The scan driver 200 may receive the first control signal SCS and at least one clock signal from the timing controller 500. In one embodiment, the scan signal supplied to one scan line in one frame period may include at least one scan pulse.

The emission driver 300 may sequentially supply emission control signals to the pixels P through the emission control lines E1 to Ei according to a second control signal ECS. The emission driver 300 may receive the second control signal ECS and a clock signal from the timing controller 500. The emission control signal may divide each of the frame periods into a light emitting period and a non-light emitting period for the pixel lines.

In one embodiment, the emission control signal may be supplied to one emission control line a plurality of times during one frame period. For example, the emission control signal may be supplied to one emission control line a plurality of times so that a logic low level and a logic high level may alternate during one frame period. A luminance (e.g., dimming luminance) of the display device 1000 may be determined according to the number of times the emission control signal is supplied and/or a length of a logic low level period (or a length of a logic high level period).

The data driver 400 may receive a third control signal DCS and an image data signal RGB from the timing controller 500. The data driver 400 may supply data signals (e.g., data voltages) to the pixels P through the data lines D1 to Dj according to the third control signal DCS and the image data signal RGB. The data driver 400 may supply data signals corresponding to a grayscale level of the image to the data lines D1 to Dj. For example, a corresponding one of the data signals may be supplied to the pixel P in synchronization with a corresponding one of the scan signals.

The timing controller 500 may control the scan driver 200, the emission driver 300, and the data driver 400 (e.g., according to timing signals supplied based on signals provided from an outside source). The timing controller 500 may supply control signals including the first control signal SCS and a scan clock signal to the scan driver 200, and supply a control signal including the second control signal ECS and an emission control clock signal to the emission driver 300. The third control signal DCS for controlling the data driver 400 may include a source start signal, a source output enable signal, a source sampling clock, and the like.

Figure 2:
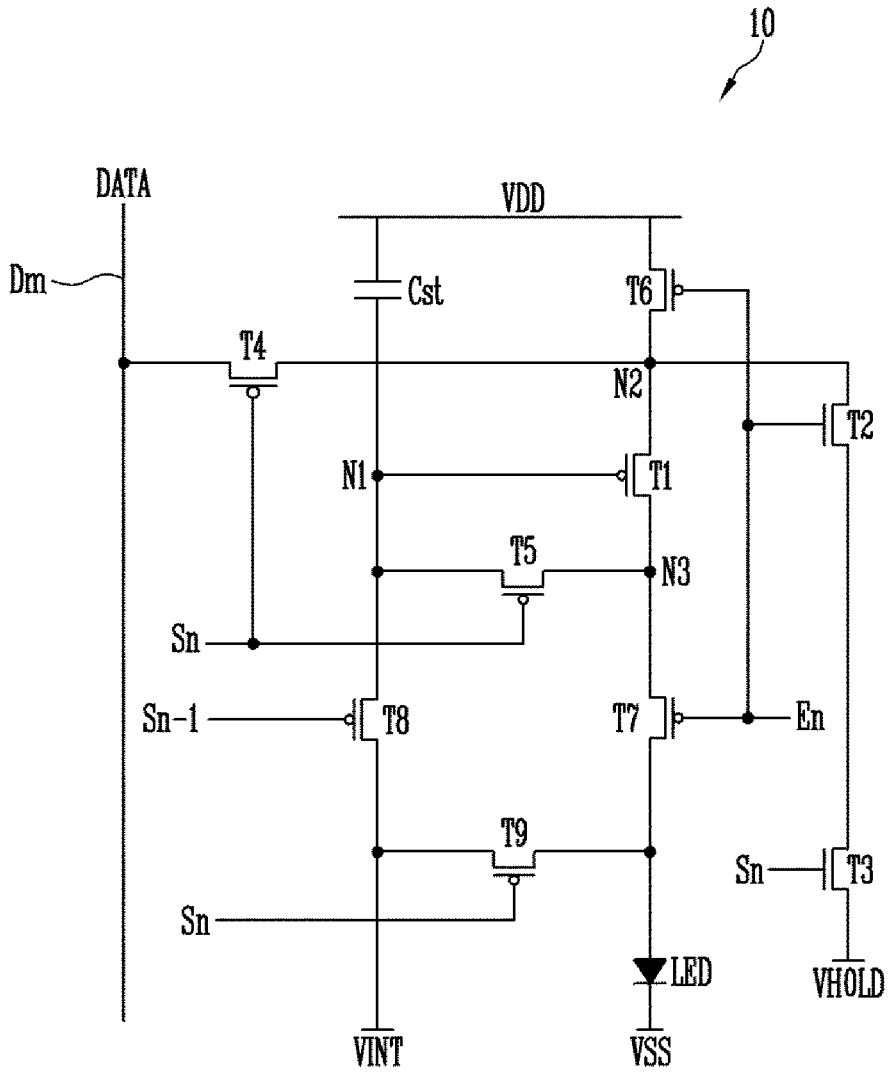
FIG. 2 is a circuit diagram illustrating a pixel according to an embodiment of the invention.

FIG. 2 is a circuit diagram illustrating a pixel according to an embodiment of the invention.

Referring to FIGS. 1 and 2, a pixel 10 may include the light emitting element LED, first through ninth transistors T1 through T9, and a storage capacitor Cst.

Referring to FIG. 2, the pixel 10 may be arranged at an (n)th row and an (m)th column, where n and m are natural numbers.

A first electrode of the light emitting element LED may be coupled to one electrode of a seventh transistor T7, and a second electrode of the light emitting element LED may be coupled to the second power source VSS. The light emitting element LED may emit light having a luminance (e.g., a predetermined luminance) corresponding to the amount of current (e.g., a driving current) supplied from the first transistor T1. In one embodiment, the light emitting element LED may be an organic light emitting diode including an organic light emitting layer. In this case, the first electrode of the light emitting element LED may be an anode electrode, and the second electrode of the light emitting element LED may be a cathode electrode. Conversely, in other embodiments, the first electrode of the light emitting element LED may be a cathode electrode, and the second electrode of the light emitting element LED may be an anode electrode.

In another embodiment, the light emitting element LED may be an inorganic light emitting element formed of an inorganic material. In another embodiment, the light emitting element LED may have a plurality of inorganic light emitting elements coupled between the second power source VSS and one electrode of the seventh transistor T7.

The first transistor T1 may be coupled between a second node N2 electrically coupled to the first power source VDD and a third node N3 electrically coupled to the first electrode of the light emitting element LED (e.g., by the seventh transistor T7). The first transistor T1 may be used to generate a driving current and provide the driving current to the light emitting element LED. A gate electrode of the first transistor T1 may be coupled to the first node N1. The first transistor T1 may function as a driving transistor of the pixel 10.

A fourth transistor T4 may be coupled between the data line (e.g., (m)th data line, Dm) and the second node N2. The fourth transistor T4 may include a gate electrode for receiving the scan signal. For example, the gate electrode of the fourth transistor T4 may be coupled to a scan line (e.g., an (n)th scan line Sn). When the fourth transistor T4 is turned on, a data voltage DATA may be transferred to the second node N2.

A fifth transistor T5 may be coupled between the first node N1 and the third node N3. The fifth transistor T5 may include a gate electrode for receiving the scan signal. For example, the gate electrode of the fifth transistor T5 may be coupled to the (n)th scan line Sn.

The fifth transistor T5 may be turned on by the scan signal to electrically connect the gate electrode of the first transistor T1 and the third node N3. Therefore, when the fifth transistor T5 is turned on, the first transistor T1 may be connected in a diode form. That is, the fifth transistor T5 may write the data voltage DATA for the first transistor T1 and compensate a threshold voltage.

The storage capacitor Cst may be coupled between the first power source VDD and the first node N1. The storage capacitor Cst may store a voltage corresponding to the data voltage DATA and the threshold voltage of the first transistor T1.

A sixth transistor T6 may be coupled between the first power source VDD and the second node N2. The sixth transistor T6 may include a gate electrode for receiving the emission control signal. The gate electrode of the sixth transistor T6 may be coupled to an emission control line (e.g., the (n)th emission control line En).

The seventh transistor T7 may be coupled between the third node N3 and the first electrode of the light emitting element LED. The seventh transistor T7 may include a gate electrode for receiving the emission control signal. The gate electrode of the seventh transistor T7 may be coupled to the (n)th emission control line En.

The sixth and seventh transistors T6 and T7 may be turned on in a gate-on period (e.g., a logic low level period) of the emission control signal, and turned off in a gate-off period (e.g., a logic high level period) of the emission control signal.

An eighth transistor T8 may be coupled between the first node N1 and the initialization power source VINT. The eighth transistor T8 may include a gate electrode for receiving the scan signal supplied to a previous scan line (e.g., a (n−1)th scan line Sn−1. For example, the gate electrode of the eighth transistor T8 may be coupled to the (n−1)th scan line Sn−1.

The eighth transistor T8 may be turned on when the scan signal is supplied to the (n−1)th scan line Sn−1 to supply the voltage of the initialization power source VINT to the first node N1. Accordingly, a voltage of the first node N1, that is, a gate voltage of the first transistor T1 may be initialized to the voltage of the initialization power source VINT. In one embodiment, the initialization power source VINT may be set to a voltage lower than the lowest voltage of the data voltage DATA.

The ninth transistor T9 may be coupled between the initializing power source VINT and the first electrode of the light emitting element LED. The ninth transistor T9 may include a gate electrode for receiving the scan signal. The gate electrode of the ninth transistor T9 may be coupled to the (n)th scan line Sn.

In another embodiment, the gate electrode of the ninth transistor T9 may be coupled to a previous or subsequent scan line (e.g., the (n−1)th scan line Sn−1 or an (n+1)th scan line Sn+1).

The ninth transistor T9 may be turned on when the scan signal is supplied, and supply the voltage of the initialization power source VINT to the first electrode of the light emitting element LED.

In one embodiment, the first, fourth, fifth, sixth, seventh, eighth and ninth transistors T1, T4, T5, T6, T7, T8 and T9 may be P-channel metal oxide semiconductor (PMOS) transistors. For example, the PMOS transistor may be formed of a Low-Temperature Poly-Silicon (LTPS) thin film transistor.

In this case, logic low levels of the emission control signal and the scan signal may be a gate-on voltage for turning on the first transistor T1 and the fourth to ninth transistors T4 to T9, and logic high levels of the emission control signal and the scan signal may be a gate-off voltage for the first transistor T1 and the fourth to ninth transistors T4 to T9.

A threshold voltage of the PMOS transistor may be shifted in a positive direction as the transistor deteriorates or driving temperature increases. For example, when the display panel 100 emits light at a high luminance for a long time, the threshold voltage of the PMOS transistors included in the pixel 10 may be shifted in the positive direction because the temperature of the display panel 100 is raised. In this case, the transistor becomes conductive with respect to a gate-source voltage under the same condition, and the amount of current flowing through the transistor may be increased.

Accordingly, when a high voltage (e.g., a low grayscale voltage or a black grayscale voltage) is transferred to the data line Dm in a non-light emitting period in which the emission control signal has a logic high level, the fourth transistor T4, the first transistor T1, and the fifth transistor T5 may be turned on (e.g., lightly turned on) and the voltage of the first node N1 may be raised. Thereafter, in the light emitting period in which the light emission control signal has the logic low level, current leakage in the first transistor T1 occurs and the light emitting element LED emits light with an undesired luminance or an undesired grayscale level. For example, display defects such as a dark line may be visually recognized.

To avoid such display defects, a margin (headroom margin) of 0.2 V or more may be applied to the gate-on voltage of the scan signal (e.g., the logic high level). Accordingly, the transistors included in the pixel 10 may be turned off (e.g., completely turned off). However, in order to raise the logic high level of the scan signal, a power source voltage for generating the logic high level may be increased. Therefore, raising the logic high level of the scan signal can increase power consumption.

In the pixel 10 according to the embodiment of the invention, a sufficiently low voltage may be applied to the second node N2 in the non-light emitting period in which no data writing is performed in order to prevent the display defects due to a threshold voltage shift. Accordingly, an unintended turn-on of the first transistor T1 can be prevented.

In an embodiment, the second transistor T2 and the third transistor T3 may be coupled in series between the second node N2 and the holding power source VHOLD. The second transistor T2 may include a gate electrode coupled to the (n)th emission control line En. The third transistor T3 may include a gate electrode coupled to the (n)th scan line Sn.

The second and third transistors T2 and T3 may be of a different type from the first transistor T1. In one embodiment, the second and third transistors T2 and T3 may be N-channel metal oxide semiconductor (NMOS) transistors. For example, the second and third transistors T2 and T3 may be N type oxide semiconductor thin film transistors.

Accordingly, the second and third transistors T2 and T3 may be turned on in response to the emission control signal having a logic high level and the scan signal having a logic high level, respectively. That is, the second and third transistors T2 and T3 may be turned on during the non-light emitting period and the voltage of the holding power source VHOLD may be supplied to the second node N2.

The voltage of the holding power source VHOLD may be set to a voltage lower than the lowest voltage of the data voltage DATA. Accordingly, when the voltage of the holding power source VHOLD is supplied to the second node N2, a voltage of the second node N2 becomes lower than a voltage of the third node N3. Therefore, the first transistor T1 can be turned off (e.g., completely turned off) during the non-light emitting period.

In one embodiment, the voltage of the holding power source VHOLD may be substantially equal to that of the initialization power source VINT. That is, the holding power source VHOLD and the initialization power source VINT may not be distinguishable. For example, the holding power source VHOLD can be replaced by the initialization power source VINT, thereby reducing manufacturing cost and complexity.

In another embodiment, the voltage of the holding power source VHOLD may be lower than that of the data voltage DATA (e.g., a voltage corresponding to a white grayscale). For example, the holding power source VHOLD and the initialization power source VINT may be generated and output from the same or different power sources.

As described above, the voltage of the holding power source VHOLD may be supplied to the second node N2 by turning on the second and third transistors T2 and T3 in the non-light emitting period in which no data writing is performed. Therefore, an unintentional activation of the first transistor T1 during the non-light emitting period may be prevented, and display defects such as a dark line may be substantially avoided.

Figure 3:
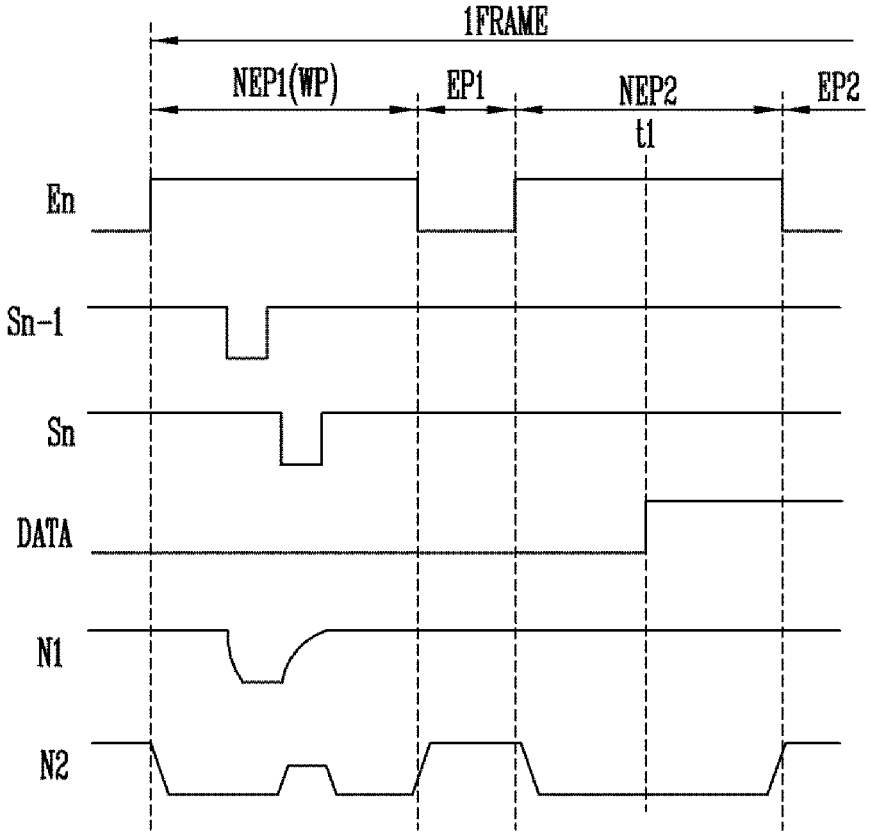
FIG. 3 is a timing chart illustrating an embodiment of an operation of the pixel of FIG. 2.

FIG. 3 is a timing chart illustrating an embodiment of an operation of the pixel of FIG. 2.

Referring to FIGS. 1-3, the emission control signal may be applied to the (n)th emission control line En a plurality of times during one frame period.

FIG. 3 shows an example of an impulse dimming driving in which one frame period includes a plurality of light emitting periods EP1 and EP2 and a plurality of non-light emitting periods NEP1 and NEP2.

In FIG. 3, the light emitting periods EP1 and EP2 included in one frame period are shown to be shorter than the non-light emitting periods NEP1 and NEP2. However, a relationship between the light emitting period and the non-light emitting period is not limited thereto. For example, lengths of the light emitting periods EP1 and EP2 may be greater than those of the non-light emitting periods NEP1 and NEP2.

In addition, luminance may be controlled by the length, the number of times, or the total length of the light emitting periods EP1 and EP2 within one frame period.

In one embodiment, the first transistor T1, and the fourth to ninth transistors T4 to T9 may be PMOS transistors, and the second and third transistors T2 and T3 may be NMOS transistors. The fourth transistor T4, the fifth transistor T5, and the ninth transistor T9 may be turned on in response to the logic low level of the scan signal, and the third transistor T3 may be turned on in response to the logic high level of the scan signal. The eight transistor T8 may be turned on in response to the logic low level of a scan signal from a (n−1) scan line Sn−1. The sixth transistor T6 and the seventh transistor T7 may be turned on in response to the logic low level of the emission control signal, and the second transistor T2 may be turned on in response to the logic high level of the emission control signal.

As shown in FIG. 3, in one embodiment, one frame period may be driven by repeating the non-light emitting periods NEP1 and NEP2 and the light emitting periods EP1 and EP2 alternately and twice. However, the number of non-light emitting periods and the number of light emitting periods are not limited thereto.

The emission control signal may have the logic high level in the non-light emitting periods NEP1 and NEP2, and the emission control signal may have the logic low level in the light emitting periods EP1 and EP2.

The scan signal may be sequentially supplied to the (n−1)th scan line Sn−1 and the (n)th scan line Sn in the first non-light emitting period NEP1. In other words, the scan signal having the logic low level may be supplied to the (n−1)th scan line Sn−1 and the (n)th scan line Sn during the first non-light emitting period NEP1. Therefore, the first non-light emitting period NEP1 may be defined as a writing period WP in which the data voltage DATA is written to the pixel 10.

The scan signal may be maintained at the logic high level during at least a portion of the first light emitting period EP1, the second non-light emitting period NEP2, and the second light emitting period EP2.

The second and third transistors T2 and T3 may be turned on and the voltage of the holding power source VHOLD may be applied to the second node N2 before the scan signal is applied to the (n−1)th scan line Sn−1 in the first non-light emitting period NEP1.

The eighth transistor T8 may be turned on by the scan signal applied to the (n−1)th scan line Sn−1 in the first non-light emitting period NEP1, and the gate voltage of the first transistor T1 may be initialized to the voltage of the initialization power source VINT.

Thereafter, the fourth transistor T4, the fifth transistor T5 and the ninth transistor T9 may be turned on by the scan signal applied to the (n)th scan line Sn, and the eighth transistor T8 may be turned off by the scan signal applied to the (n−1)th scan line Sn−1. Therefore, the data voltage DATA may be supplied to the first node N1, the first transistor T1 may be diode-connected, and the threshold voltage of the first transistor T1 may be compensated. In addition, as described above, the threshold voltage is compensated and the voltage of the first electrode of the light emitting element LED may be initialized to the voltage of the initialization power source VINT.

Thereafter, the emission control signal supplied to the (n)th emission control line En may have the logic low level in the first light emitting period EP1. Accordingly, the sixth and seventh transistors T6 and T7 may be turned on, and the light emitting element LED may emit light at a luminance corresponding to the data voltage DATA.

In the second non-light emitting period NEP2, both the emission control signal and the scan signal may have the logic high level. Accordingly, the second and third transistors T2 and T3 may be turned on and the voltage of the holding power source VHOLD may be supplied to the second node N2.

On the other hand, a magnitude of the data voltage DATA may be changed at a time point (e.g., at a predetermined time point) (hereinafter referred to as a first time point t1) of the second non-light emitting period NEP2. For example, the data voltage DATA may be changed to supply the data voltage DATA to a pixel different from the current pixel 10, and the different pixel may emit light based on the changed data voltage DATA.

When the data voltage DATA changed at the first time point t1 has a relatively high voltage, the fourth transistor T4 whose threshold voltage is shifted may be turned on. Accordingly, current leakage through the first transistor T1 may occur.

However, the first transistor T1 may be kept in an off state (e.g., a fully turned-off state) because the voltage of the second node N2 is held at a sufficiently low voltage (that is, the voltage of the holding power source VHOLD) by the turned-on second and third transistors T2 and T3.

Therefore, a change in the voltage of the first node N1 in the second non-light emitting period NEP2 is prevented, and display defects such as luminance/greyscale change and a dark line in the second light emitting period EP2 can be substantially avoided.

In addition, because of the addition of the second and third transistors T2 and T3, the headroom margin may not be applied to the logical high level of the scan signal, so that power consumption may be improved (e.g., reduced).

Figure 4:
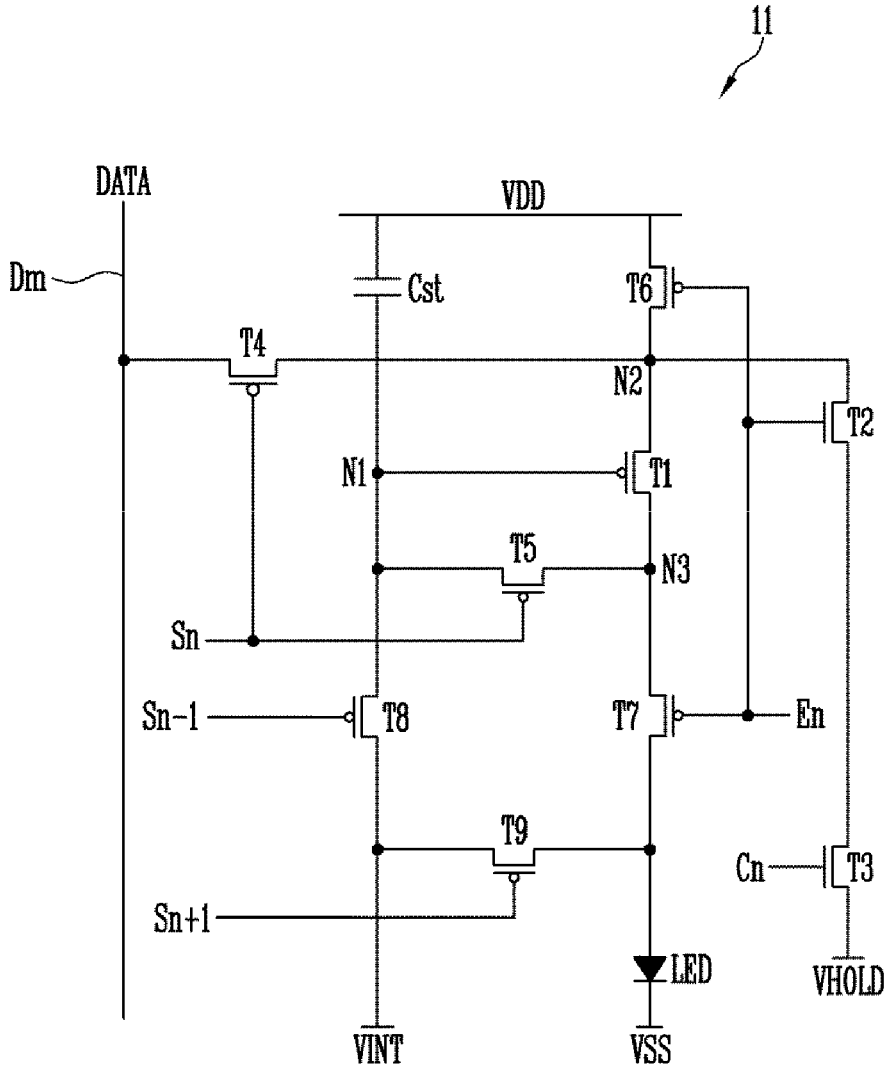
FIG. 4 is a circuit diagram illustrating an embodiment of the pixel included in the display device of FIG. 1.

FIG. 4 is a circuit diagram illustrating an embodiment of the pixel included in the display device of FIG. 1.

In FIG. 4, the same reference numerals are used for the components described with reference to FIG. 2, and redundant description of these components may be omitted. In addition, a pixel 11 of FIG. 4 may be substantially the same as or similar to the pixel 10 of FIG. 2, except for signals that control the third transistor T3 and the ninth transistor T9.

Referring to FIGS. 2 and 4, the pixel 11 may include the light emitting element LED, the first through ninth transistors T1 through T9, and the storage capacitor Cst.

In one embodiment, a gate electrode of the ninth transistor T9 may be coupled to the (n+1)th scan line Sn+1. Accordingly, when the scan signal is supplied to the (n+1)th scan line Sn+1, the ninth transistor T9 may be turned on to initialize the voltage of a first electrode of the light emitting element LED.

In one embodiment, a gate electrode of the third transistor T3 may be coupled to an (n)th control line Cn that transfers a separate control signal. Accordingly, the third transistor T3 may be turned on when the control signal is supplied to the (n)th control line Cn.

Figure 5:
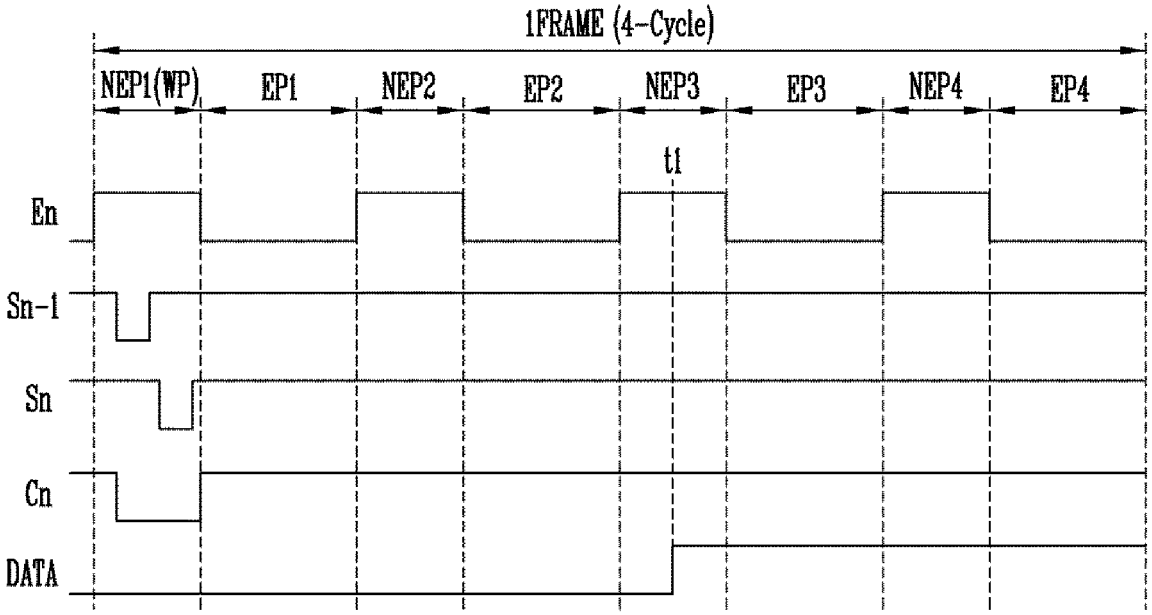
FIG. 5 is a timing chart illustrating an embodiment of an operation of the pixel of FIG. 4.

FIG. 5 is a timing chart illustrating an embodiment of an operation of the pixel of FIG. 4.

In FIG. 5, the same reference numerals are used for the components described with reference to FIG. 3, and redundant description of these components may be omitted. In addition, the timing chart of FIG. 5 may be substantially the same as or similar to the operation of the pixel of FIG. 3 except for the number of cycles of the light emitting/non-light emitting periods and the inclusion of the control signal.

Referring to FIGS. 2-5, an emission control signal may be supplied to the (n)th emission control line En a plurality of times during one frame period.

In one embodiment, one frame period may include four non-light emitting periods NEP1 to NEP4 and four light emitting periods EP1 to EP4, and may be driven in a four-cycle scheme so that the luminance can be controlled.

In one embodiment, a period in which the control signal Cn has a logic low level may be greater than a low level period of the scan signal Sn or Sn−1 in a first non-light emitting period NEP1. For example, a logic low level period of the control signal may overlap the low level period of the scan signal (e.g., overlapping the low level period of the scan signals supplied by the scan lines Sn and Sn−1).

However, a width of the low level period of the control signal is not limited thereto. For example, the control signal may be substantially the same as the timing of the scan signal supplied to the (n)th scan line Sn.

The second and third transistors T2 and T3 may be turned on in a second non-light emitting period NEP2, a third non-light emitting period NEP3 and a fourth non-light emitting period NEP4, and the voltage of the second node N2 may be the voltage of the holding power source VHOLD. Therefore, even if the data voltage DATA rises at the first time point t1, turn-off states of the fourth transistor T4, the first transistor T1, and the like included in the pixel 11 can be maintained.

Therefore, display defects such as luminance/brightness change of the pixel 11 and a dark the line can be substantially avoided.

Figure 6:
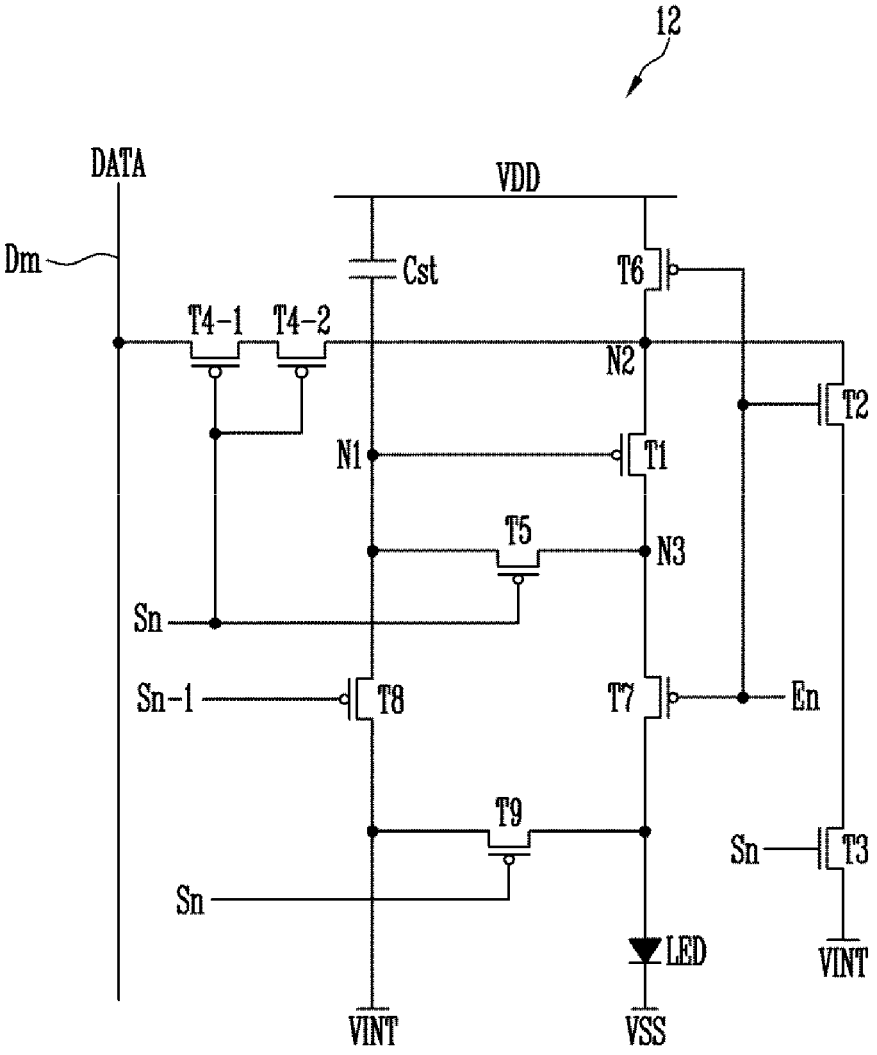
FIG. 6 is a circuit diagram illustrating an embodiment of the pixel included in the display device of FIG. 1.

FIG. 6 is a circuit diagram illustrating an embodiment of the pixel included in the display device of FIG. 1.

In FIG. 6, the same reference numerals are used for the components described with reference to FIG. 2, and redundant description of these components may be omitted. In addition, a pixel 12 of FIG. 6 may have substantially the same as or similar to the pixel 10 of FIG. 2 except for a configuration of the fourth transistor T4.

Referring to FIGS. 2 and 6, the pixel 12 may include the light emitting element LED, the first through ninth transistors T1 through T9, and the storage capacitor Cst.

In one embodiment, fourth transistors T4-1 and T4-2 may have a multiple gate electrode commonly connected to the (n)th scan line Sn. For example, the fourth transistors T4-1 and T4-2 may have a dual gate electrode structure.

A channel resistance of the fourth transistors T4-1 and T4-2 may be increased because of the dual gate electrode structure. Therefore, even if threshold voltages of the fourth transistors T4-1 and T4-2 are shifted in the positive direction, the turn-on of the fourth transistors T4-1 and T4-2 due to a high data voltage DATA applied to another pixel can be prevented.

In one embodiment, the initialization power source VINT may be coupled to one electrode of the third transistor T3. For example, the third transistor T3 may be coupled between the second transistor T2 and the initialization power source VINT.

Display defects due to a threshold voltage shift may be substantially avoided by the fourth transistors T4-1 and T4-2 having a multiple gate electrode, and the second and third transistors T2 and T3 which are NMOS transistors.

As described above, the pixel 12 according to the embodiments of the invention and the display device having the same may include the second and third transistors T2 and T3 for supplying a holding voltage to the second node N2 in the non-light emitting period after data writing, so that display defects such as a dark line (or unexpected horizontal lines) and a luminance change due to the threshold voltage shift of the transistors can be substantially avoided.

In addition, because of the addition of the second and third transistors T2 and T3, the headroom margin may not be applied to the logical high level of the scan signal, so that power consumption can be reduced.

As described above, embodiments of the invention have been disclosed through the detailed description and the drawings. It is to be understood that the terminology used herein is for the purpose of describing the invention only and is not used to limit the scope of the invention described in the claims or their equivalents. Therefore, those skilled in the art will appreciate that various modifications and equivalent embodiments are possible without departing from the scope of the invention. Accordingly, the true scope of the invention should be determined by the technical idea of the appended claims and their equivalents.

What is claimed is:

1. A pixel comprising:

a light emitting element;

a first transistor configured to control an amount of current flowing from a first power source to a second power source via the light emitting element corresponding to a voltage applied to a first node; and second and third transistors coupled in series between a holding power source and a second node coupled to one electrode of the first transistor, the second transistor comprising a gate electrode coupled to an emission control line, and the third transistor comprising a gate electrode coupled to a scan line, a fourth transistor coupled between a data line and the second node, the fourth transistor comprising a gate electrode coupled to the scan line;

a fifth transistor coupled between the first node and a third node, the fifth transistor comprising a gate electrode coupled to the scan line;

a sixth transistor coupled between the first power source and the second node, the sixth transistor comprising a gate electrode coupled to the emission control line;

a seventh transistor coupled between the third node and the light emitting element, the seventh transistor comprising a gate electrode coupled to the emission control line; and a storage capacitor coupled between the first power source and the first node.

2. The pixel of claim 1, further comprising:

an eighth transistor coupled between the first node and an initialization power source, the eight transistor comprising a gate electrode coupled to a previous scan line; and a ninth transistor coupled between the initialization power source and the light emitting element, the ninth transistor comprising a gate electrode coupled to the scan line.

3. The pixel of claim 2, wherein the holding power source and the initialization power source are the same.

4. The pixel of claim 2, wherein a voltage of the holding power source is lower than a lowest voltage of a data voltage supplied to the data line.

5. The pixel of claim 2, wherein the first transistor, and the fourth through ninth transistors are PMOS transistors, and wherein the second and third transistors are NMOS transistors.

6. The pixel of claim 1, wherein the fourth transistor comprises a multiple gate electrode transistor that is commonly coupled to the scan line.

7. The pixel of claim 1, wherein an emission control signal is applied to the emission control line a plurality of times during one frame period.

8. The pixel of claim 1, wherein the second transistor is turned on in response to a logic high level of an emission control signal, and wherein the third transistor is turned on in response to a logic high level of a scan signal.

9. The pixel of claim 8, wherein the sixth and seventh transistors are turned on in response to a logic low level of the emission control signal.

10. The pixel of claim 8, wherein the fourth and fifth transistors are turned on in response to a logic low level of the scan signal.

11. A display device comprising:

a display panel comprising a plurality of pixels;

a scan driver configured to supply scan signals to the plurality of pixels through a plurality of scan lines;

an emission driver configured to supply emission control signals to the plurality of pixels through a plurality of emission control lines; and a data driver configured to supply data voltages to the display panel through a plurality of data lines, wherein an (m, n) pixel of the plurality of pixels (m and n are natural numbers) comprises:

a light emitting element;

a first transistor configured to control an amount of current flowing from a first power source to a second power source via the light emitting element corresponding to a voltage applied to a first node; and second and third transistors coupled in series between a holding power source and a second node coupled to one electrode of the first transistor, wherein the one electrode of the first transistor is configured to receive a respective one of the data voltages from an (m)th data line of the data lines, wherein the second transistor comprises a gate electrode coupled to an (n)th emission control line of the plurality of emission control lines, wherein the third transistor comprises a gate electrode coupled to an (n)th scan line of the plurality of scan lines, and wherein the (m, n) pixel further comprises:

a fourth transistor coupled between the (m)th data line and the second node, the fourth transistor comprising a gate electrode coupled to the (n)th scan line;

a fifth transistor coupled between the first node and a third node, the fifth transistor comprising a gate electrode coupled the (n)th scan line;

a sixth transistor coupled between the first power source and the second node, the sixth transistor comprising a gate electrode coupled to the (n)th emission control line;

a seventh transistor coupled between the third node and the light emitting element, the seventh transistor comprising a gate electrode coupled to the (n)th emission control line; and a storage capacitor coupled between the first power source and the first node.

12. The display device of claim 11, wherein the (m, n) pixel further comprises:

an eighth transistor coupled between the first node and an initialization power source, the eighth transistor comprising a gate electrode coupled to an (n−1)th scan line of the plurality of scan lines; and a ninth transistor coupled between the initialization power source and the light emitting element, the ninth transistor comprising a gate electrode coupled to the (n)th scan line.

13. The display device of claim 12, wherein the second and third transistors are NMOS transistors, and wherein the first transistor, and the fourth through ninth transistors are PMOS transistors.

14. The display device of claim 12, wherein a corresponding one of the emission control signals is supplied to the (n)th emission control line a plurality of times during one frame period.

15. The display device of claim 12, wherein the holding power source and the initialization power source are the same.

* * * * *